US006152265A

United States Patent [19]

Bittar et al.

[11] Patent Number: 6,152,265

[45] Date of Patent: Nov. 28, 2000

[54] ACCOMMODATING VISUALLY HANDICAPPED IN ELEVATOR UP-PEAK CHANNELING

[75] Inventors: Joseph Bittar, Avon, Conn.; Joseph V. Bledsoe, Jr., Bedford, Tex.; Bruce A. Powell, Canton, Conn.; Steven M. Skolnick, Simsbury; Michael H. Wilson, Unionville, both of Conn.

[73] Assignee: Otis Elevator, Farmington, Conn.

[21] Appl. No.: 09/385,536

[22] Filed: Aug. 30, 1999

[51] Int. Cl.[7] ..... B66B 1/20

[52] U.S. Cl. ..... 187/384; 187/901; 187/382

[58] Field of Search ..... 187/380, 382, 187/384, 385, 387, 388, 389, 391, 392, 901

[56] References Cited

U.S. PATENT DOCUMENTS 4,673,911 6/1987 Yoshida ..... 187/100

4,685,538 8/1987 Kamaike ..... 187/121

4,979,594 12/1990 Begle et al. ..... 187/121

5,382,761 1/1995 Amano ..... 187/383

5,984,051 11/1999 Morgan et al. ..... 187/392

*Primary Examiner*—Jonathan Salata

[57] ABSTRACT

In an elevator system utilizing up-peak channeling which displays the floors of the sectors to be served by each elevator during its next trip, visually handicapped persons alert the system by means of a signal transmission from a portable device, and are then enabled to enter a car call for any floor in the building. An embodiment with a lobby receiver enables calls to any floor in the next several elevators which may leave the lobby floor. An embodiment with receivers in every car enables calls to any floor in a car which receives the signal.

8 Claims, 4 Drawing Sheets

ACCOMMODATING VISUALLY HANDICAPPED IN ELEVATOR UP-PEAK CHANNELING

TECHNICAL FIELD

This invention relates to allowing visually handicapped persons to enter car calls for any floor on elevator cars scheduled to travel only to a sector serving a limited number of floors, in elevator up-peak channeling operations.

BACKGROUND ART

The term "channeling" refers to operation of elevator systems during up-peak in which each elevator car is successively assigned to serve only a particular sector of floors. An example is disclosed in U.S. Pat. No. 4,804,069. In some systems, the number of floors within each sector is dynamically adjusted so as to balance the number of passengers in each of the cars as they leave the lobby. An example of this type of system is disclosed in U.S. Pat. Nos. 4,846,311, and 5,168,133.

The problem with channeling systems is that the only way in which passengers can know which elevator car to take in order to reach their destination floor is by visually observing a display of the floor number range of the sector to be served during the next trip of each elevator, as each elevator stands at the lobby loading passengers. Of course, visually handicapped persons are deprived of that information. The prior art has suggested utilizing audio announcements of the sector floor numbers, but that obviously results in a cacophony of numbers which inundate the potential passenger and render it difficult to discern the direction from which the desired range of numbers may be coming from so as to locate the elevator.

DISCLOSURE OF INVENTION

Objects of the invention include provision of a channeling system which easily handles visually handicapped passengers; which does not degrade service by unacceptable noise; and which does not unduly degrade the efficiency of channeling operation.

According to the present invention, a visually handicapped person desiring elevator service provides a signal indicative of the fact that he or she is visually handicapped. In one embodiment, the signal is utilized in the group controller to authorize a limited number of cars to permit calls to be entered for any destination whatsoever, even though the calls are normally limited during channeling to destination floors within the assigned floor range of the sector. In another embodiment, the car which the visually handicapped person enters receives the signal and is conditioned to allow calls to any floor.

Since the average potential passenger has no idea that a car will accept calls to any floor to accommodate the visually handicapped, all of the passengers except the visually handicapped will continue to enter the appropriate car as evidenced by the visual display of the sector floors. Thus, there is minimum degradation of the effective channeling operation as a consequence of the present invention.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
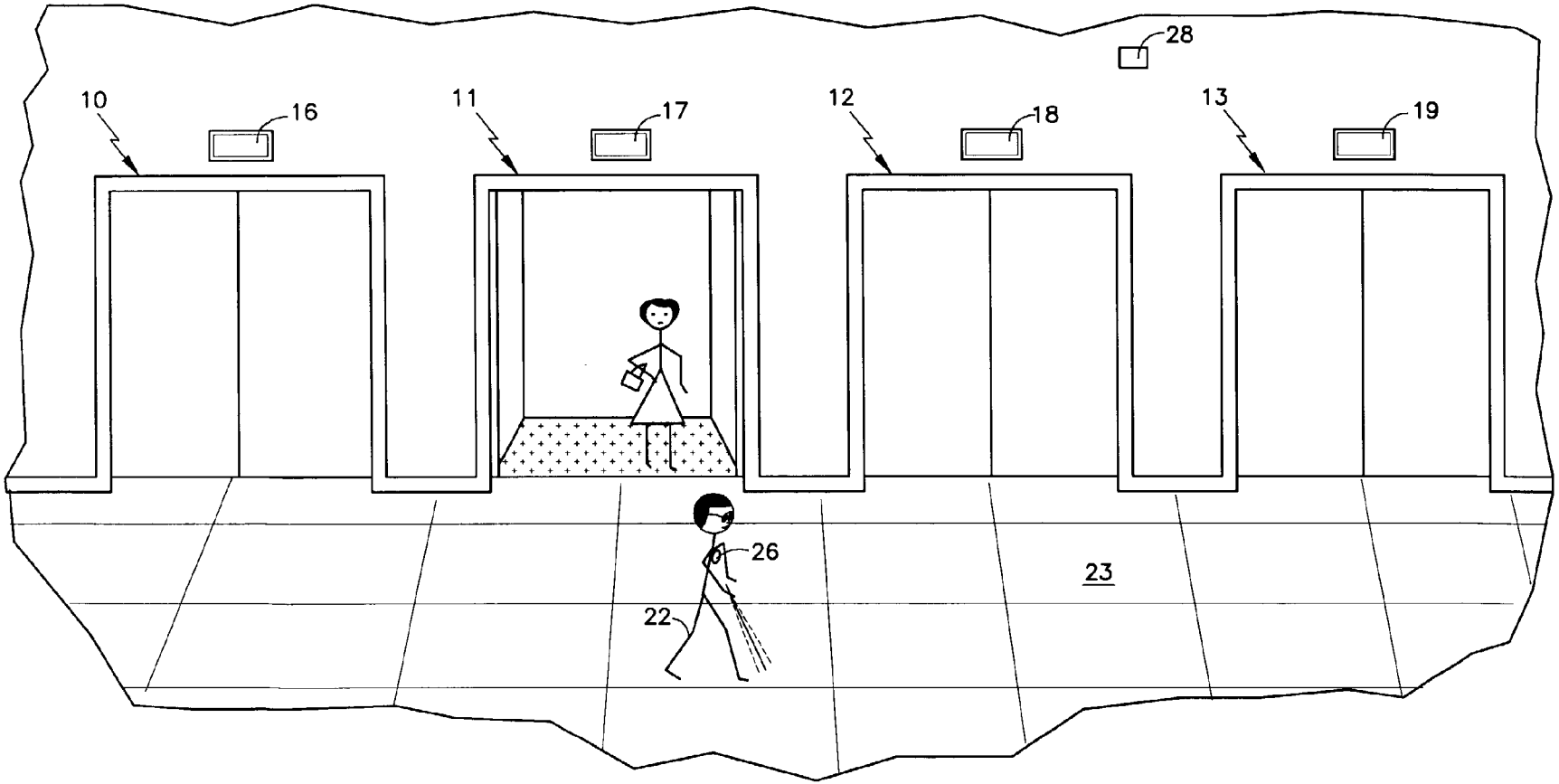
FIG. 1 is a simplified, stylized front elevation view of an elevator lobby.

Referring to FIG. 1, a plurality of elevators 10–13 each has a corresponding electroluminescent display (ELD) 16–19, each of which will display, during up-peak channeling, the floor numbers of the sector to be served by the related car on the next upward trip from the lobby. The display may be, for instance, "9–17", or the like. A visually handicapped person 22 proceeding into the elevator lobby corridor 23 will be unable to discern the sector inclusive of his destination floor.

The visually handicapped potential passenger 22 wears a portable device 26 which transmits a signal to be received by a device 28 disposed adjacent the lobby corridor 23. The device 26 may be operated by a battery or other portable power source, and may be turned on by the passenger 22 whenever he deems it necessary, to thereafter continually emit some code that would alert the elevator group control that a visually handicapped person is approaching the elevators. On the other hand, the device 28 may be a radio frequency identification device (RFID) transponder which transmits a beacon signal, and the device 26 may be a passive, RFID transponder which is powered by the radio frequency signal received from the device 28, and transmits the necessary code in response thereto. Or, the device 26 may be operated by a battery or other portable power supply, and be in a sleep mode until it is awakened by a periodic transmission from the device 28, which comprises a transponder that will wake up the device 26 to cause it to transmit the code, and the device 28 will then receive the code to inform the group controller of the passenger's presence.

Figure 2:
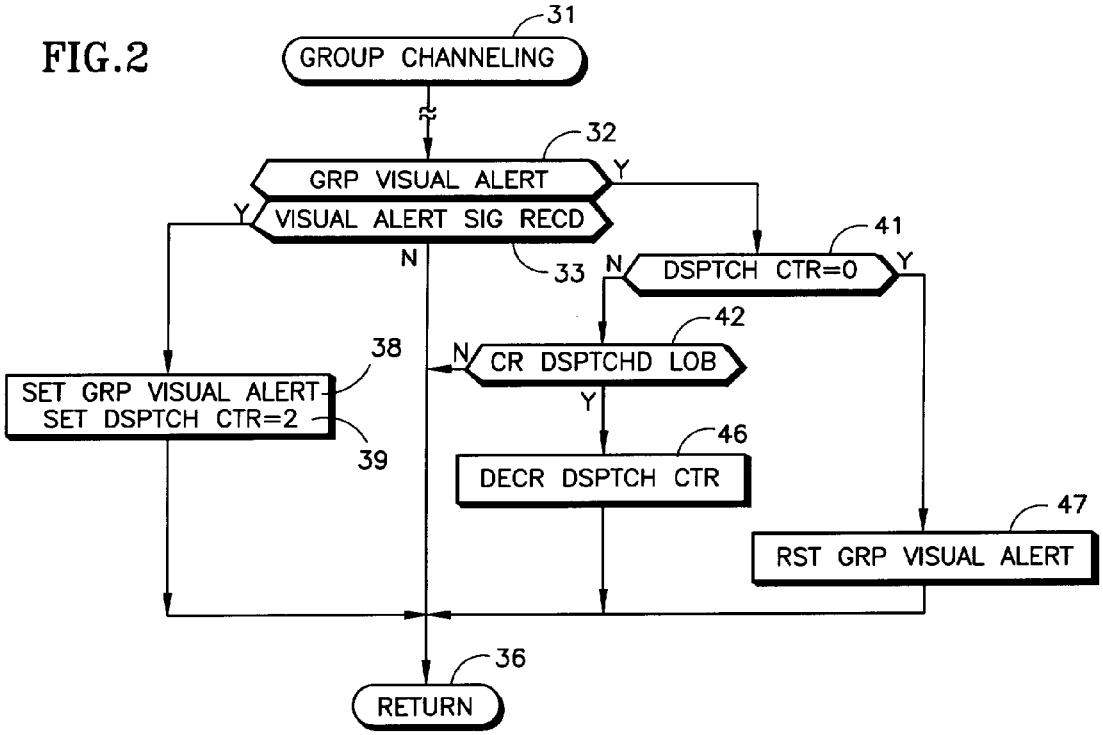
FIG. 2 is a flow diagram of high level group functions illustrating principles of the invention.

In FIG. 2, the functions which may be performed for all of the elevators may be performed in a group channeling routine of any sort, which may be reached through an entry point 31. Among other functions which may be performed, a group visual alert state may be established whenever a virtually handicapped person is present. A test 32 may determine if a group visual alert has been set as yet, or not. In the general case, it will not have been, so a test 33 determines if a visual alert signal has been received by the device 28 from the device 26. If it has not, which is the general case, other programming will be reverted to through a return point 36. But if a visually handicapped passenger 22 enters the lobby corridor 23 and causes a signal to be received by the device 28, an affirmative result of test 33 will reach a step 38 to set a group visual alert flag, and a step 39 to set a dispatch counter (described hereinafter) to some suitable count, which may be two. Then other programming is reached through the return point 36. In a subsequent pass through the routine of FIG. 2, test 32 will now be affirmative reaching a test 41 to determine if the dispatch counter (set in step 39) has been decremented to zero, or not. Initially, it will not have been, so a test 42 determines if a car has been dispatched from the lobby since the last pass through the routine. In the general case, there will be many passes through the routine of FIG. 2 between times when cars are dispatched from the lobby. A negative result of test 42 will cause other programming to be reached through a return point 36. Eventually, a car will be dispatched from the lobby, and in a subsequent pass through the routine of FIG. 2 test 42 will be affirmative reaching a step 46 to decrement the dispatch counter which was set in step 39. Then other programming is reached through the point 36. Additional passes through the routine of FIG. 2 will find a negative result of test 41 and a negative result of test 42. Eventually, test 42 will again be affirmative thus decrementing the dispatch counter to zero. In the next following pass through the routine of FIG. 2, test 41 is affirmative reaching a step 47 to reset the group visual alert. Therefore, the group visual alert flag will be available until two additional cars have left the lobby from the time it was first set in response to the presence of the passenger 22 in the elevator lobby 23.

Figure 3:
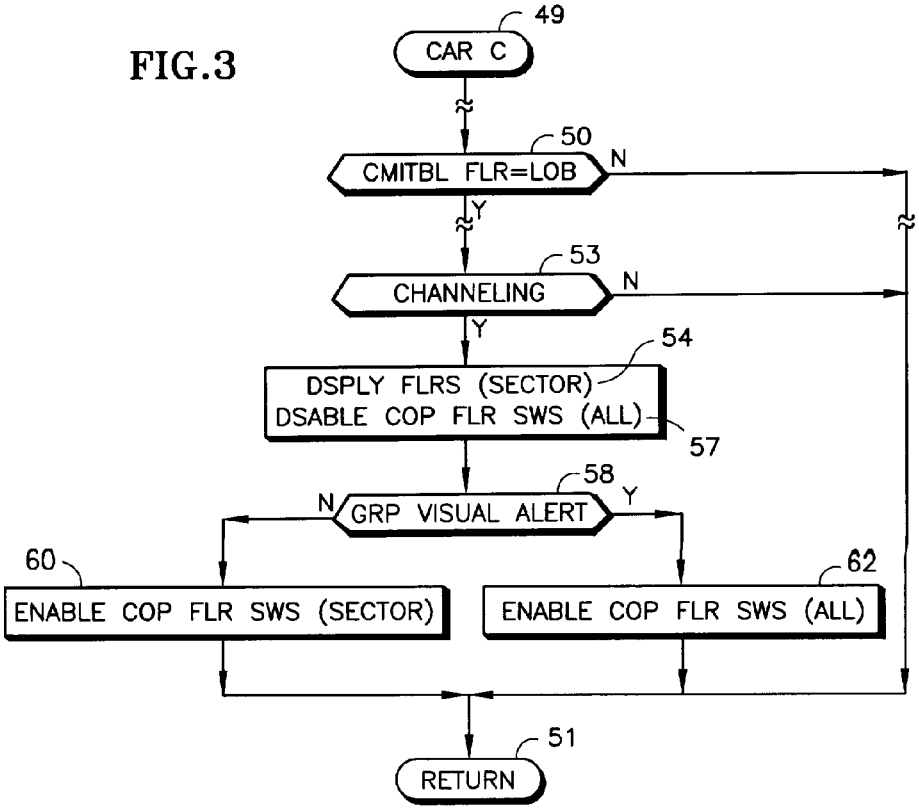
FIG. 3 is a flow diagram of high level car functions illustrating principles of the invention.

Referring to FIG. 3, various car routines in each of the cars may perform functions related to the invention. For instance, a general car routine for car C is reached through an entry point 49 and a first test 50 related to the present invention determines if the committable floor for this elevator is the lobby or not. If not, other programming is reverted to through a return point 51. But if the committable floor for the lobby is 50, among other functions which may be performed, a test 53 determines whether channeling is in effect or not. If not, other programming is reverted to; but if so, a step 54 will cause the electroluminescent display 16–19 related to car C to display the floors for the sectors to be served by that car, such as "18–26". Then, a step 57 will disable the car operating panel floor switches (the car call switches) for all of the floors. A test 58 determines if the group visual alert is in effect as described with respect to FIG. 2. In the usual case, it will not be, so a step 60 will enable car operating panel floor switches for only those floors in the sector to which the car has been assigned for its next trip. But if the group visual alert is set, an affirmative result of test 58 will reach a step 62 to enable the car operating panel floor switches for all of the floors which may be served by the elevator. This is the gist of the present invention.

As an alternative to counting the number of cars which leave the lobby, a timer may be used. In that case, the step 39 will preset the timer to some interval, such as 40 seconds, the test and step 42 and 46 will be eliminated, and test 41 will simply determine if the timer has timed out or not, reaching step 47 after the time out. Other operational details may be selected, if desired.

Figure 4:
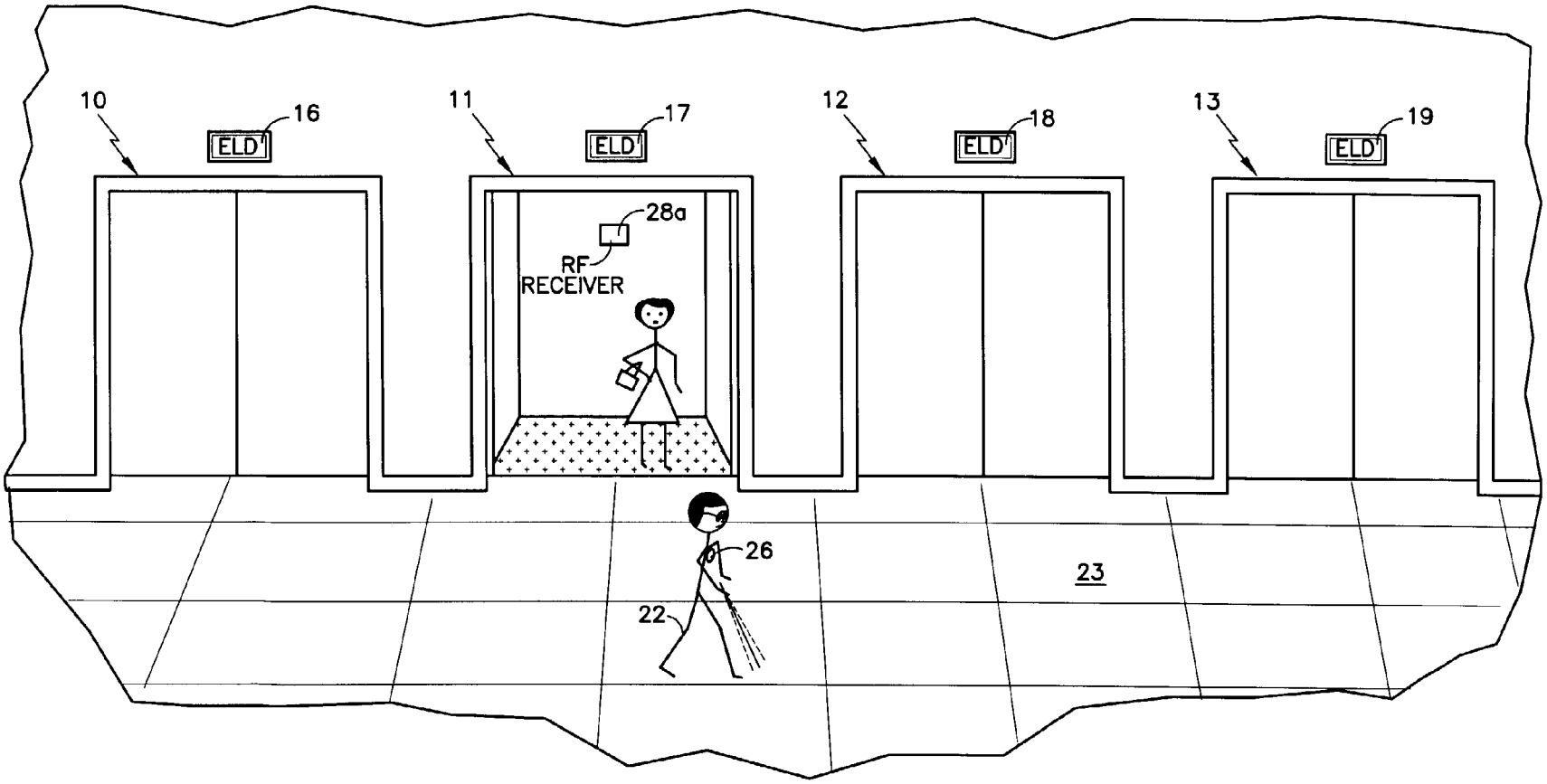
FIGS. 4 and 5 illustrate alternative embodiments.
Figure 5:
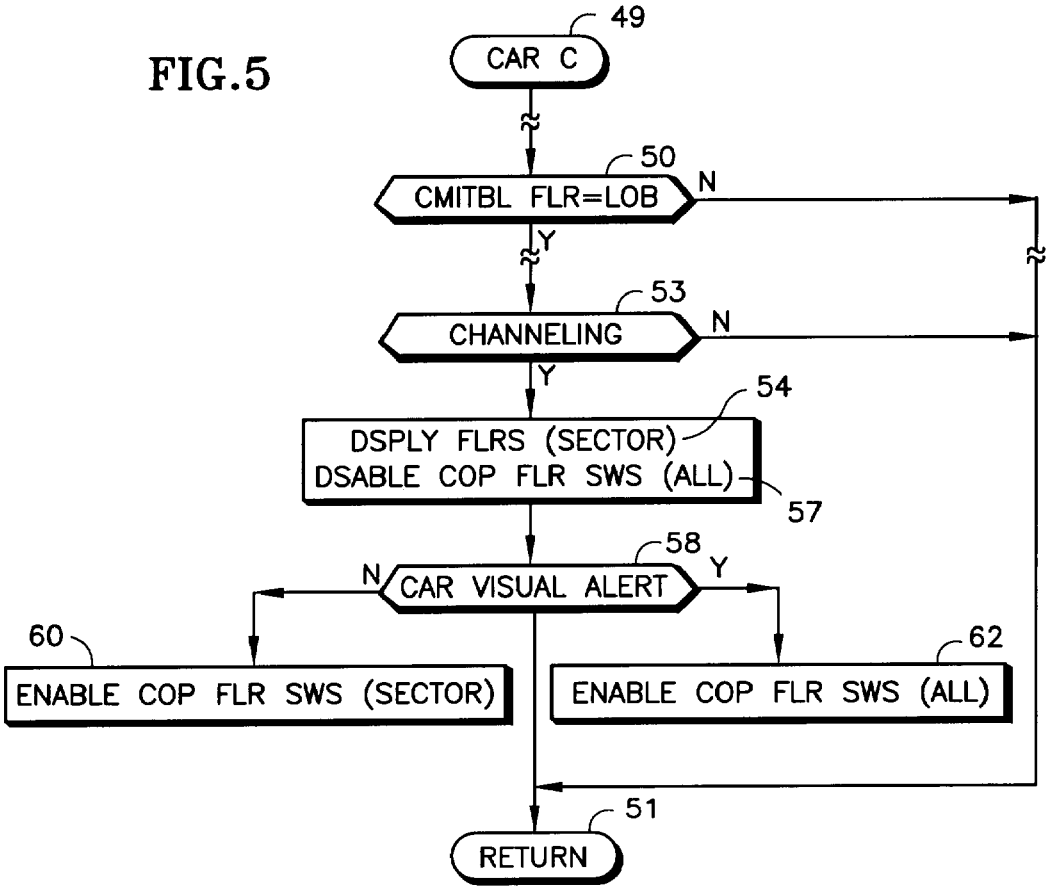

An alternative embodiment of FIGS. 4 and 5 has a receiver 28*a* in each car. Only that car is enabled to enter calls for any floor, as shown in FIG. 5.

All of the aforementioned patents are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of accommodating visually handicapped persons in an elevator system serving a plurality of floors of a building, in which up-peak channeling assigns successive cars loading passengers at a lobby floor to serve only a sector containing a specific group of contiguous floors, each car being conditioned to accept car calls only for floors within the assigned sector, comprising:

(a) transmitting an electromagnetic radiation signal from a device worn by a visually handicapped person when said handicapped person is within said building seeking elevator service; and (b) in response to receipt of said signal, conditioning at least one elevator car at said lobby to accept car calls for any floor which said elevator car is capable of serving.

2. A method according to claim 1 wherein said step (b) comprises:

(c) receiving said signal in said lobby; and (d) conditioning one or more elevator cars, which will be the cars to leave the lobby after receipt of said signal, to accept car calls for any floor which said elevator cars are capable of serving.

3. A method according to claim 2 wherein said step (d) comprises conditioning two elevator cars.

4. A method according to claim 1 wherein said step (b) comprises:

receiving said signal within one of said elevator cars boarding passengers at said lobby floor; and conditioning said one elevator car to accept car calls for any floor which said elevator car is capable of serving.

5. An elevator system, including a bank of elevators operable during up-peak in a channeling mode in which each elevator is assigned to serve only a sector of contiguous floors and each elevator is conditioned to accept car calls only for destination floors within the assigned sector, comprising:

a portable device to be worn by a visually handicapped person for supplying an electromagnetic signal transmission indicating the presence of said visually handicapped person;

one or more receivers related to said bank of elevators; and means responsive to receipt of said signal transmission by said one or more receivers for conditioning at least one elevator car which is about to leave the lobby to accept car calls for any floor which said elevator car is capable of servicing.

6. A system according to claim 5 wherein:

said one or more receivers comprises a single receiver for receiving said signal within said lobby; and said last named means conditions one or more elevator cars, which will be the next cars to leave the lobby after receipt of said signal, to accept car calls for any floor which said elevator cars are capable of serving.

7. A system according to claim 6 wherein:

said last named means conditions two cars.

8. A system according to claim 5 wherein:

said one or more receivers comprise a receiver in each of said elevators; and said last named means comprises means responsive to receipt of said signal within one of said elevator cars to condition said one elevator car to accept car calls for any floor which said elevator car is capable of serving.

* * * * *